United States Patent [19]

Ahmed

[11] 4,061,959

[45] Dec. 6, 1977

[54] VOLTAGE STANDARD BASED ON SEMICONDUCTOR JUNCTION OFFSET POTENTIALS

[75] Inventor: Adel Abdel Aziz Ahmed, Annandale, N.J.

[73] Assignee: RCA Corporation, New York, N.Y.

[21] Appl. No.: 729,767

[22] Filed: Oct. 5, 1976

[51] Int. Cl.[2] ..... G05F 1/58

[52] U.S. Cl. ..... 323/1; 307/297; 323/19; 323/22 T; 323/68

[58] Field of Search ..... 323/1, 4, 9, 22 T, 68, 323/19; 330/22, 27, 38 R; 307/297, 310

[56] References Cited

U.S. PATENT DOCUMENTS

| | | | |
|---|---|---|---|
| 3,430,155 | 2/1969 | Harwood | 320/22 |
| 3,617,859 | 11/1971 | Dobkin et al. | 323/4 |
| 3,794,861 | 2/1974 | Bernacchi | 323/4 |
| 3,887,863 | 6/1975 | Brokaw | 323/19 |
| 3,908,162 | 9/1975 | Marley et al. | 323/68 |
| 3,942,046 | 3/1976 | Limberg | 307/297 |
| 3,970,876 | 7/1976 | Allen et al. | 323/22 T |

*Primary Examiner*—Gerald Goldberg

*Attorney, Agent, or Firm*—H. Christoffersen; A. L. Limberg

[57] ABSTRACT

A first junction transistor, the emitter-to-base potential ($V_{BE}$) of which determines the negative-temperature-coefficient component of the standard voltage, is provided with direct-coupled collector-to-base feedback for adjusting its $V_{BE}$ to condition the transistor to conduct, as collector current, substantially all of an applied current that is temperature-independent or varies linearly with temperature. The positive-temperature-coefficient component of the standard voltage is developed as the difference between the offset potentials of a pair of semiconductor junctions, one of which may be the base-emitter junction of the first transistor. The negative- and positive-temperature-coefficient potentials are linearly combined to provide the standard voltage.

6 Claims, 3 Drawing Figures

VOLTAGE STANDARD BASED ON SEMICONDUCTOR JUNCTION OFFSET POTENTIALS

Figure 1:
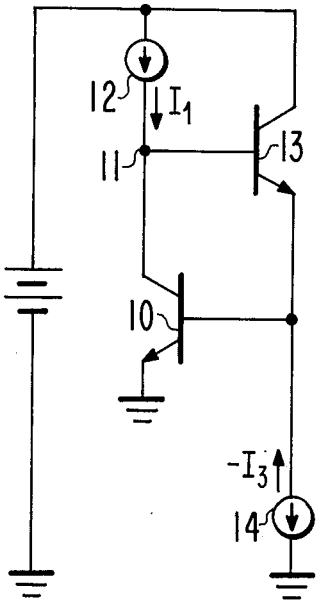

Voltage standards of the following type are known in the prior art. The positive-temperature-coefficient difference between the offset potentials of a pair of semiconductor junctions operated at the same absolute temperature T is scaled up and added to the negative-temperature-coefficient offset potential of one of the pair. The standard voltage is a potential characteristics of the offset potential across a junction with relatively high density of current flow therethrough, and with appropriate scaling, is a zero-temperature-coefficient standard voltage.

Voltage standards of such type, which are customarily built in monolithic integrated circuit form, are described in U.S. Pat. Nos. 3,617,859 (Dobkin et al.), and 3,887,863 (Brokaw). The reader is also referred to the following articles:

1. "New Developments in IC Voltage Regulators," R.J. Widlar, *IEEE Journal of Solid State Circuits,* Vol. SC-6, No. 1, pp. 2–7, February 1971
2. "A Precision Reference Voltage Source," K.E. Kuijk, *IEEE Journal of Solid State Circuits,* Vol. SC-8, No. 3, pp. 222–226, June 1973
3. "A Simple Three-Terminal IC Bandgap Reference," A.P. Brokaw, *Digest of Papers,* 1974 *ISSCC, pp.* 188–189.

The present invention is embodied in a voltage standard wherein a first junction transistor is provided with direct-coupled collector-to-base feedback for adjusting its emitter-to-base potential, or $V_{BE}$, to condition the transistor to conduct as collector current substantially all of an applied current. This applied current either is temperature-independent or varies linearly with temperature. The resulting $V_{BE}$ is summed with a positive-temperature-coefficient component to obtain the standard voltage. This positive-temperature-coefficient potential may be developed, for example, as the difference between the offset potentials of a pair of semiconductor junctions, one of which may be the base-emitter junction of the first transistor.

In the drawing:

FIG. 1 is a schematic diagram of a $V_{BE}$ supply similar to that described by Harwood in U.S. Pat. No. 3,430,155; and each of FIGS. 2 and 3 is a schematic diagram of a voltage standard embodying the present invention.

In The FIG. 1 $V_{BE}$ supply, a transistor 10 has its collector connected to a first circuit node 11 to which a positive current $I_1$ from a current source 12 is applied. Transistor 10 is provided with direct-coupled collector-to-base feedback, applied by means including a potential follower, shown as an emitter-follower transistor 13. This feedback places an emitter-to-base potential on transistor 10 that conditions it to accept all of $I_1$ as its collector current, except for a small portion of $I_1$ required as base current for transistor 13. If the collector current of transistor 10 is too small, the excess portion of $I_1$ raises the potential at node 11 to a more positive value. The potential-follower action of transistor 13 increases the emitter-to-base potential of transistor 10, and transistor 10 responds with increased collector current demand. If the collector current of transistor 10 is too large, it causes the potential at node 11 to drop to a less positive value. The potential follower action of transistor 13 decreases the emitter-to-base potential of transistor 10, and transistor 10 responds with decreased collector current demand.

Except for the increment of current drawn by the base electrode of transistor 10 in order to support its collector current, the emitter current of transistor 13 is determined by the negative current $-I_3$ supplied to it by a current source 14. Interestingly, increasing the value of $I_3$ does not affect the emitter-to-base potential of transistor 10 appreciably. The collector-to-base feedback of transistor 10 continues to adjust its emitter-to-base potential to a value to cause transistor 10 to demand a collector current substantially equal to $I_1$. The increased emitter current of transistor 13 increases its base-to-emitter offset potential somewhat, however, responsive to which the potential at node 11 increases by a slight amount. The transconductance of transistor 10 is not much affected by change in its emitter-to-collector potential—that is to say, the so-called Early effect is a weak effect—particularly where the changes are less than a volt and where the transistors have reasonably large base widths. The increase in the emitter current of transistor 13 caused by increase in $I_3$ is accompanied by a proportional increase in the base current of transistor 13, but $I_3$ is easily arranged to be small enough that only a negligible fraction of $I_1$ is diverted to the base electrode of transistor 10 and at the same time to be large enough to predominate over the base current of a transistor biased for the same level of collector current flow as transistor 10.

Figure 2:
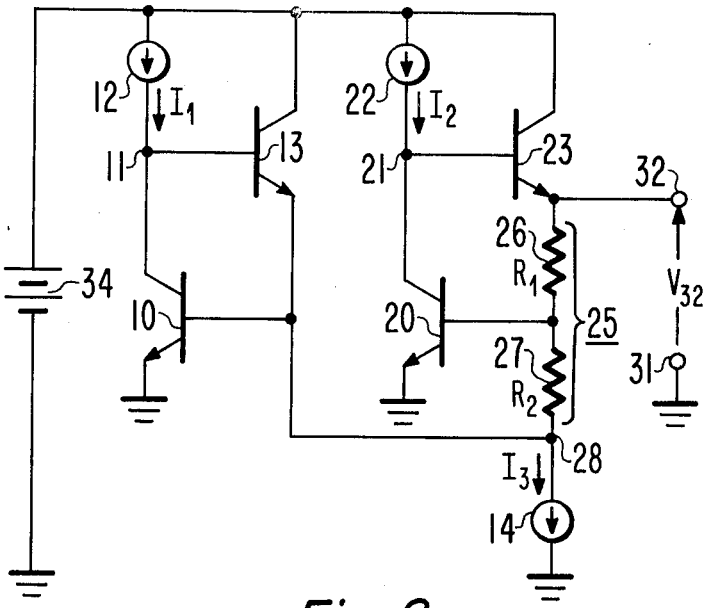
Figure 3:
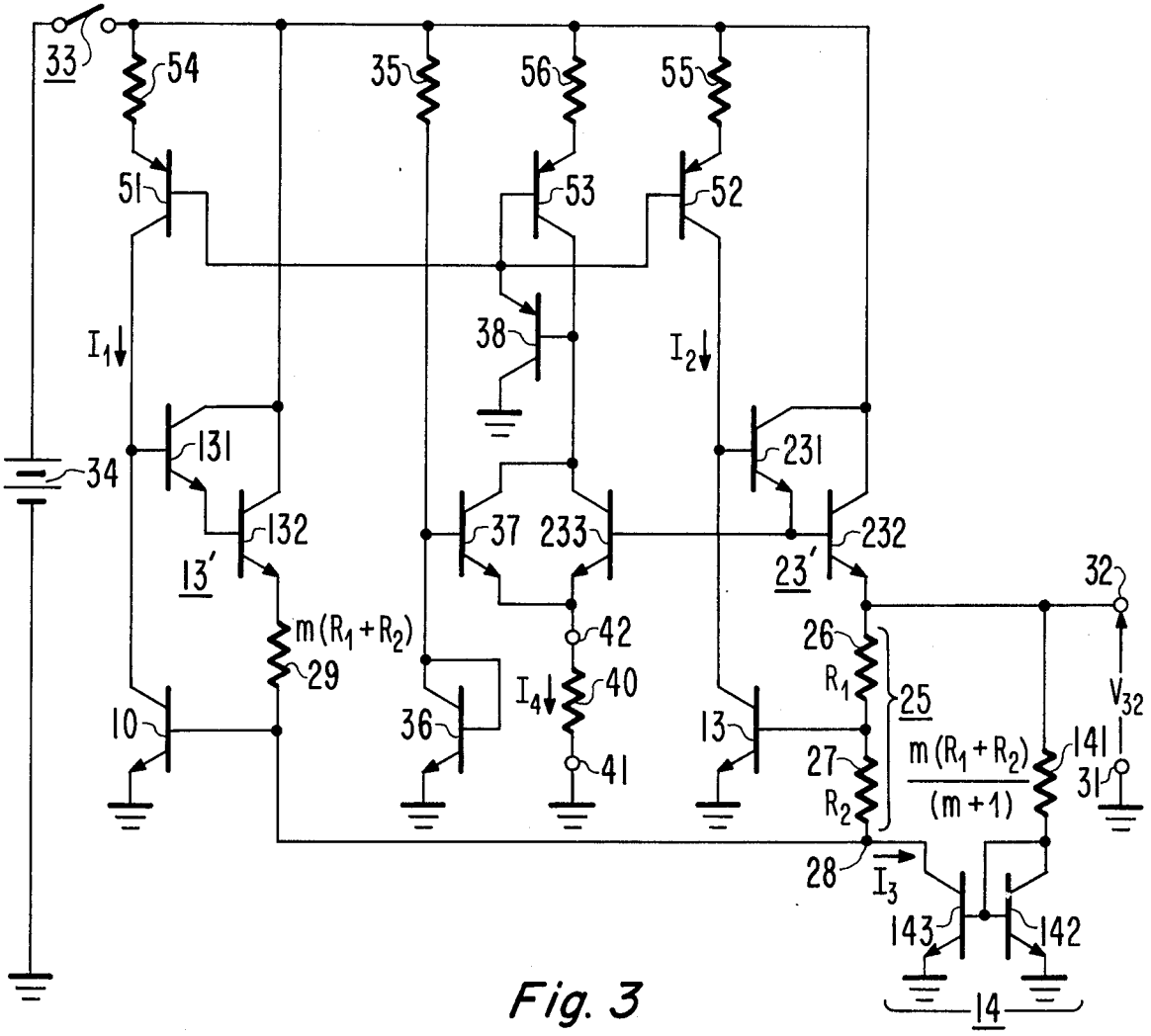

FIG. 2 shows a voltage standard which can be used for supplying a temperature-independent voltage substantially equal to the extrapolated zero Kelvin bandgap $V_{g(0)}$ of the semiconductor material from which transistors 10, 13, 20 and 23 are made. This voltage, about 1.2 volts, if the transistors are a silicon type, is supplied between a first terminal 31 at ground reference potential and a second terminal 32. The FIG. 2 circuit includes in addition to the FIG. 1 structure further, similar structure comprising transistor 20 having its collector electrode connected to second circuit node 21 to which a positive current $I_2$ from a current source 22 is applied. $I_2$ is in constant proportion to $I_1$, and the currents $I_1$ and $I_2$ are either independent of temperature or vary linearly with change in the absolute temperature at which transistors 10 and 20 are operated.

Transistor 20 is provided with direct coupled collector-to-base feedback applied by means including a potential follower, shown as an emitter-follower transistor 23, and a potential divider 25. This feedback places an emitter-to-base potential on transistor 20 that conditions it to accept all $I_2$ as its collector current, except for a small portion of $I_2$ required as base current for transistor 23. The potential divider 25 has its input circuit connected between the emitter electrodes of transistors 13 and 23 and its output circuit connected between the base electrodes of transistors 10 and 20. Potential divider 25 is shown as being a resistive potential divider comprising resistive elements 26 and 27 having resistances $R_1$ and $R_2$, respectively. Resistive element 26 has a first end connected to output terminal 32 to which the emitter electrode of transistor 23 is galvanically coupled. Resistive element 27 has a first end connected to a third circuit node 28 direct coupled to the base electrode of transistor 10. The second ends of resistive elements 26 and 27 are connected to an interconnection direct coupled to the base electrode of transistor 20.

From the observations with regard to the FIG. 1 structure, it follows that the base-emitter potential $V_{BE10}$ and $V_{BE20}$ of transistors 10 and 20 are not appreciably affected by the ratio between the portions of $I_3$ withdrawn as emitter currents from transistors 13 and 23, respectively. Rather, $V_{BE10}$ and $V_{BE20}$ are determined by the collector-to-base feedback of transistors 10 and 20, respectively, adjusting their collector currents to be substantially equal to $I_1$ and $I_2$, respectively.

Generally, the operation of a transistor obeys the following equation quite closely.

$$V_{BE} = (kT/q) ln (I_C/AJ_S) \quad (1)$$

where $V_{BE}$ is the base-emitter potential of the transistor,
$k$ is Boltzmann's constant,
T is the absolute temperature of the transistor,
$q$ is the charge on an electron,
$I_C$ is the collector current of the transistor,
$A$ is the effective area of the transistor base-emitter junction; and
$J_S$ is the density of current flow through that junction where $V_{BE} = 0$. By proportioning $I_2/I_1$ to exceed $A_{10}/A_{20}$, in a particular amount, $V_{BE20}$ can be made to exceed $V_{BE10}$ by a predictable factor times the absolute temperature at which transistors 10 and 20 are operated. Equation 2, following, describes this phenomenon more particularly.

$$(V_{BE20} - V_{BE10}) = (kT/q) \, ln \, (I_2A_{10}/I_1A_{20}) \quad 2.$$

As long as that portion of $I_3$ flowing through resistances 26 and 27 greatly exceeds the base current of transistor 20, substantially the same current flows through the resistances 26 and 27, so that the following relationship obtains by application of Ohm's Law.

$$V_{32} - V_{BE10} = [1+(R_1/R_2)] (V_{BE20} - V_{BE10}) = [1 + (R_1/R_2)] (kT/q) \, ln \, (I_2A_{10}/I_1A_{20}) \quad [3)$$

$V_{32}$ is the potential between terminals 31 and 32.

$$V_{32} = (kT/q) \, ln \, (I_1/A_{10}J_S) + [1+R_1/R_2](kT/q) \, ln \, (I_2A_{10}/I_1A_{20}) \quad (4)$$

That is, $V_{32}$ is the sum of a potential term equal to $V_{BE10}$, which being dependent on $J_S$, exhibits a decrease with increase in temperature, and another potential term which increases linearly with increase in temperature. $V_{32}$ is equivalent to the base-emitter potential of a transistor operated with a density of current flow through its base-emitter junction which is proportional to, but much higher than, that through the base-emitter junction of transistor 20. With proper selector of $R_1$:$R_2$, $I_1/A_{10}$ and $I_2/A_{20}$, $V_{32}$ can be made substantially temperature independent.

To obtain a simple voltage standard adequate for many applications, current sources 12 and 22 may each consist of a simple resistance; and current source 14 may be either a simple resistance or a self-biased transistor used as a forward-biased diode in current mirror amplifier configuration with transistor 10. Such simple voltage standards employ only local feedback, the collector-to-base feedback of transistor 10 and of transistor 20, and are substantially less prone to self-oscillation than prior art voltage standards.

The present invention and the prior art voltage standards scale up the difference between the offset potentials between two forward biased junctions by the ratio of the resistance of two diffused resistors to obtain the positive-temperature coefficient component of the standard voltage. Prior art practice has been to develop the negative-temperature-coefficient of the standard voltage across a semiconductor junction, the current through which depends directly upon the current flowing through these diffused scaling resistors in response to the positive-temperature-coefficient potential appearing across them. The present applicant finds this is undesirable in critical applications where the standard voltage is to exhibit as little change with temperature as possible, since it introduces a second order term into the variation of the negative-temperature-coefficient offset potential which cannot subsequently be compensated for by adjusting the proportions of the positive- and negative-temperature-coefficient components of the standard voltage. Voltage standards which embody the present invention avoid introduction of this second order term if they are operated with $I_1$ and $I_2$ currents which either do not vary with temperature or which vary linearly with temperature.

FIG. 3 shows a voltage standard, preferably in monolithic form, that is an example of how this may be done. The NPN transistors are conventional vertical structure transistors with common emitter forward current gains, or $h_{fe}$'s, of 30 or more. Initially, after switch 33 is closed to apply operating potential from d-c supply 34, current flows through resistor 35 and self-biased transistor 36 to bias transistor 37 for forward conduction. Transistor 37 is provided with emitter degeneration by a resistor 40 connected between terminal 41 at ground and terminal 42 to which the emitter of 37 is connected. The resistance of resistor 40 is chosen sufficiently large that the collector current of transistor 37 tends to be small compared to the current flow through elements 35 and 36, but is sufficiently large to bias transistor 38 into conduction. Emitter-follower transistor 38, which may be a vertical structure PNP to obtain better $h_{fe}$, in turn biases PNP's 51, 52 and 53 into conduction. PNP transistors 51, 52 and 53 will be lateral-structure transistors since their collectors are not grounded, and are provided with emitter degeneration resistors 54, 55 and 56, respectively, to provide better tracking of their collector-current-versus-base-potential characteristics.

A portion of the collector current $I_2$ of transistor 52 flows as base current to transistor 231 connected in cascade with each of transistors 232 and 233, the former Darlington cascade connection acting as a composite transistor 23'. As transistor 233 is brought into conduction, a regenerative feedback loop is activated which includes transistor 233 operating as a common-emitter amplifier; the current mirror amplifier configuration comprising elements 38, 52, 53, 55 and 56, and transistor 231 operating as a common-collector amplifier. This regenerative feedback loop acts to increase the current levels in each of the transistors in the whole circuit, with the notable exception of transistor 37. As the emitter current of transistor 233 increases, the potential drop across resistor 40 increases, first decreasing the forward bias of the base-emitter junction of transistor 37 and then reversing the bias to half conduction of transistor 37.

The gain of the regenerative loop is decreased as transistor 13 is biased into conduction, and applies local degenerative feedback to reduce the current gain of transistor 231. When unity gain of the regenerative loop is reached, $I_1$ and $I_2$ assume their equilibrium values and are proportioned in the same ratio as the respective collector current versus base potential characteristics of transistors 51 and 52. $R_1$:$R_2$ and $I_1$:$I_2$ preferably are chosen to provide, under these circumstances, a $V_{32}$ that is substantially equal to $V_{g(0)}$ and is therefore temperature independent.

Assuming the emitter-to-base offset potentials of transistors 232 and 233 to be substantially equal, the potential appearing between terminals 41 and 42 is substantially equal to $V_{32}$ and is therefore temperature independent. If resistor 40 has a resistance that is temperature-independent the current therethrough will by Ohm's Law be temperature-independent. If resistor 40 has a resistance that varies linearly with absolute temperature, the current flow $I_4$ therethrough will by Ohm's Law vary linearly with absolute temperature. In order to get these desired resistance characteristics, resistor 40 can be a resistor external to the monolithic integrated circuit, a film resistor deposited on an insulated surface of the monolithic integrated die, or a very heavily doped resistor diffused or ion-implanted into the die itself.

$I_4$ is supplied as emitter current from the emitter of transistor 233, in response to which a collector current is demanded by transistor 233 which has substantially the same degree of temperature dependency as $I_4$, inasmuch as the common-base current gain of transistors are substantially temperature-independent. The direct-coupled collector-to-base feedback connection of transistor 53 via emitter-follower transistor 38 adjusts the collector current of PNP transistor 53 to equal the collector current of NPN transistor 233. The collector current of transistor 53 exhibits substantially the same degree of temperature dependency as $I_4$. Transistors 51 and 52 are in current mirror amplifier configuration with transistor 53, so their collector currents are in fixed proportion to the collector current of transistor 53. That is, $I_1$ and $I_2$ each exhibit either no change with change in temperature or linear change with change in temperature.

In the FIG. 3 voltage standard, the Darlington cascade of transistors 131 and 132 provides a compound transistor 13'. Resistor 29, used to connect the emitter of transistor 132 to the base electrode of transistor 10, is shown as having a resistance $m$ times as large as that of the serial connection of resistors 26 and 27, and $m$ may be chosen with a view towards proportioning the base currents of transistors 131 and 231 in the same ratio as $I_1$ and $I_2$. Current source 14 is shown comprising a resistor 141 and transistors 142 and 143 in current mirror amplifier configuration. Selecting the resistance of resistor 141 to be $m/(m+1)$ times that of the serial connection of resistors 26 and 27 causes $I_3$ to be of a value such that the potential drop across resistor 29 equals that across the serial connection of resistors 26 and 27. This equalizes the collector potentials of transistors 10, 13, 51, 52 and 53, eliminating tracking errors between the NPN's and amongst the PNP's due to Early effect.

Many other modified forms of the circuits described in connection with FIGS. 2 and 3 will suggest themselves to one skilled in the art of circuit design. Transistors 13 and 23 may be field effect types to eliminate discrepancies between $I_1$ and the collector current of transistor 10 and between $I_2$ and the collector current of transistor 20, for example. Transistors 10 and 20 may be compound transistors comprising respective Darlington cascade connections of like numbers of component transistors, as a further example. Or transistors 10 and 20 may be compound transistors, each comprising respective transistors with like numbers of diode or self-biased transistor elements in their emitter connections. The sources of currents $I_1$, $I_2$ and $I_3$ may take a variety of known forms. All such modifications and such others as utilize the novel teachings offered in connection with the circuits of FIGS. 2 and 3 are to be considered within the scope of the present invention.

What is claimed is:

1. A voltage standard for supplying predetermined voltage, said voltage standard comprising:

a first transistor having base and emitter electrodes and a base-emitter junction therebetween, having a collector electrode and being operated at an absolute temperature substantially equal to T;

a first source of current having no non-linear dependence upon the absolute temperature T;

means for applying the current from said first source of current between the emitter and collector electrodes of said first transistor;

a direct-coupled degenerative collector-to-base feedback connection of said first transistor for adjusting the emitter-to-base potential of said first transistor to condition said first transistor to conduct substantially all of said current applied thereto from said first source of current;

a second transistor having base and emitter electrodes with a base-emitter junction therebetween, having a collector electrode, and being operated at an absolute temperature substantially equal to T;

a second source of current for supplying a current proportional to that supplied by said first source of current;

means for applying the current from said second source of current between the emitter and collector electrodes of said second transistor;

a direct-coupled degenerative collector-to-base feedback connection of said second transistor for adjusting the emitter-to-base potential of said second transistor to condition said second transistor to conduct substantially all of said current applied thereto from said second source of current; and scaling means responsive to the difference between the emitter-to-base potentials of said first and said second transistors for providing a positive-temperature-coefficient potentials; and means for summing the emitter-to-base potential of said first transistor and said positive-temperature-coefficient potential, thereby to obtain said predetermined voltage.

2. A voltage standard comprising:

first and second and third terminals, said first and said second terminals for receiving an operating potential therebetween, said first and said third terminals for supplying the standard voltage;

first and second transistors of a first conductivity type, each having base and emitter electrodes with a base-emitter junction therebetween, having a collector electrode, being operated at an absolute temperature substantially equal to T, and having its emitter electrode connected directly to said first terminal without substantial intervening impedance;

a potential divider having an input circuit connected between said third terminal and the base electrode of said first transistor and having an output circuit connected between the base electrodes of said first and said second transistors;

third and fourth and fifth transistors of said first conductivity type, and sixth and seventh and eighth transistors of a second conductivity type complementary to said first, each of said transistors having first and second and third electrodes and a principle conduction path between its first and second electrodes, the conductivity of which path is controlled by the potential appearing between its first and third electrodes;

means connecting the first electrode of said third transistor to the base electrode of said first transistor;

an interconnection between the collector electrode of said first transistor and the second electrode of said sixth transistor, which interconnection is direct coupled to the third electrode of said third transistor; means connecting the first electrode of said fourth transistor to said third terminal;

an interconnection between the collector electrode of said second transistor and the second electrode of said seventh transistor, which interconnection is direct coupled in like manner to the third electrodes of said fourth and said fifth transistors;

means connecting each of the second electrodes of said third and fourth transistors to said second terminal;

a resistance connecting the first electrode of said fifth transistor to said first terminal;

an interconnection between the second electrodes of said fifth and said eighth transistors, which interconnection is direct coupled in like manner to the third electrodes of said sixth and seventh and eighth transistors;

means connecting the first electrodes of said sixth and seventh and eighth transistors to said second terminal for operating them in current mirror amplifier relationship; and a source of bias current connected between the base and emitter electrodes of said first transistor for maintaining said third transistor in conduction irrespective of the conduction of said fourth transistor.

3. A voltage standard for supplying a predetermined voltage between first and second terminals, said voltage standard comprising:

first and second transistors each operated at substantially the same absolute temperature T, each having base and emitter electrodes with a base-emitter junction therebetween and a collector electrode, the emitter electrode of each being directly connected to said first terminal without substantially intervening impedance;

a first circuit node to which collector electrode of said first transistor is connected;

a second circuit node to which the collector electrode of said second transistor is connected;

a third circuit node connected to the base electrode of said first transistor;

supply means for supplying first, second and third currents to said first circuit node, to said second circuit node, and to said third circuit node, respectively, said first and second currents being of a first polarity and in fixed proportion to each other, said third current being of a second polarity opposite to said first polarity;

means applying direct-coupled collector-to-base feedback to said first transistor for conditioning it to accept substantially all of said first current as its collector current, which means includes a first potential follower having an input connection to which said first circuit node is direct coupled and having an output connection, and which means also includes means galvanically connecting the output connection of said first potential follower to said third circuit node;

potential divider means responsive to the potential appearing between the base electrode of said first transistor and said second terminal for applying a fraction thereof between the base electrodes of said first and said second transistors;

means applying direct-coupled collector-to-base feedback to said second transistor for conditioning it to accept substantially all of said second current as its collector current, which means includes a second potential follower having an input connection to which said second circuit node is direct coupled and having an output connection galvanically connected to said second terminal, and which means also includes said potential divider means.

4. A voltage standard as set forth in claim 3 wherein said supply means includes:

means for supplying a temperature independent said first current to said first circuit node; and means for supplying a temperature independent said second current to said second circuit node.

5. A voltage standard as set forth in claim 3 wherein said supply means includes:

means for supplying a said first current linearly dependent upon T to said first circuit node; and means for supplying a said second current linearly dependent upon T to said second circuit node.

6. A voltage standard as set forth in claim 3 wherein said potential divider means comprises:

first and second resistances in constant proportion to each other, the first resistance being connected between said second terminal and the base electrode of said second transistor, and the second resistance being connected between the base electrodes of said first and second transistors.

* * * * *